US008307877B1

(12) United States Patent
Lambridis et al.

(10) Patent No.: US 8,307,877 B1
(45) Date of Patent: Nov. 13, 2012

(54) TWO-SIDED FIRE DOOR WITH SINGLE MOTOR DRIVE

(75) Inventors: Andrew C. Lambridis, Brooklyn, NY (US); Ashraf Gomaa, Staten Island, NY (US); Oscar A. Escobar, Glendale, NY (US)

(73) Assignee: McKeon Rolling Steel Door Co., Brooklyn, NY (US)

( * ) Notice: Subject to any disclaimer, the term of this patent is extended or adjusted under 35 U.S.C. 154(b) by 775 days.

(21) Appl. No.: 11/348,795

(22) Filed: Feb. 7, 2006

Related U.S. Application Data

(63) Continuation-in-part of application No. 11/133,984, filed on May 20, 2005, now abandoned.

(51) Int. Cl.
*E06B 3/48* (2006.01)

(52) U.S. Cl. ..... 160/118; 160/4; 160/190

(58) Field of Classification Search ..... 160/4, 9, 160/84.02, 118, 199, 190, 191; 16/81
See application file for complete search history.

(56) References Cited

U.S. PATENT DOCUMENTS 781,665 A * 2/1905 Kusch ..... 160/193
1,043,492 A * 11/1912 Werner et al. ..... 160/199
1,626,764 A * 5/1927 Thorne ..... 160/199
3,437,125 A * 4/1969 Hargrove ..... 160/193
3,981,343 A * 9/1976 DeVito ..... 160/9
4,296,791 A * 10/1981 Chaumat et al. ..... 160/206
5,143,137 A * 9/1992 West ..... 160/199
5,259,433 A * 11/1993 Cloutier ..... 160/190
5,386,891 A * 2/1995 Shea ..... 188/171
5,482,103 A * 1/1996 Burgess et al. ..... 160/9
6,098,695 A * 8/2000 Schwingle ..... 160/199
6,155,324 A * 12/2000 Elliott et al. ..... 160/1
6,484,784 B1 * 11/2002 Weik et al. ..... 160/7
6,662,848 B2 * 12/2003 Goodman et al. ..... 160/84.02
7,299,847 B1 * 11/2007 Evans ..... 160/1

* cited by examiner

*Primary Examiner* — David Purol
(74) *Attorney, Agent, or Firm* — Cozen O'Connor

(57) ABSTRACT

A two-sided fire door system includes a horizontal head track having a first end and a second end; a first door including a plurality of interconnected panels suspended vertically from the head track by trolleys arranged for horizontal movement between the first end and a point remote from the first end; a second door including a plurality of interconnected panels suspended vertically from the head track by trolleys arranged for horizontal movement between the second end and a point remote from the second end; and an endless chain in an elongate loop having a first end looped around a drive sprocket and parallel first and second runs fixed to respective first and second lead trolleys. A drive motor rotates the drive sprocket in opposite rotational directions to open and close the doors, the motor being blocked against rotation when the motor is not operating. A suspended weight closes the doors automatically by means of a cable attached to one of the lead trolleys when the blocking is released.

30 Claims, 6 Drawing Sheets

TWO-SIDED FIRE DOOR WITH SINGLE MOTOR DRIVE

CROSS-REFERENCE TO RELATED APPLICATIONS

The present application is a continuation-in-part of U.S. patent application Ser. No. 11/133,984 filed May 20, 2005, now abandoned, the disclosure of which is incorporated herein by reference.

BACKGROUND OF THE INVENTION

1. Field of the Invention

The invention relates to a motor-driven fire door, particularly a two-sided fire door, having an automatic closing feature.

2. Description of the Related Art

Two-sided fire doors have first and second doors which are movable toward each other to close the doors and away from each other to open the doors. The doors each include a plurality of panels which are suspended from a head track by trolleys and are hinged together so that they can pivot relative to each other. Where adjacent panels are hinged to pivot in opposite directions so that the panels can fold against each other to form a stack, the door is referred to as an accordion-type door. Where adjacent panels are hinged to pivot in the same direction so that the door can travel around curves and be wound onto a coil, the door is referred to as a sliding door. In both cases the doors are driven by respective motors and acted on by respective weights to draw them closed when power to the motor and/or brake from the fire alarm or smoke detection system is interrupted. As such, a two-door system requires two motors and two sets of weights (or a battery backup system) or other mechanism urging toward a closed position or, in some cases, toward an open position.

SUMMARY OF THE INVENTION

It is a principle object of the present invention to provide a two-sided fire door wherein both doors are jointly driven in opposite directions by a single motor, and both doors are jointly closed (or alternatively opened) by a single urging mechanism such as a suspended weight or a backup battery powered arrangement.

According to the invention, a two-sided fire door system includes an endless chain in an elongate loop having a first end looped around a drive sprocket, a second end looped around at least one idler sprocket, a first run extending between the ends of the loop on one side of the head track, and a second run extending between the ends of the loop on the other side of the track. The first and second lead trolleys are fixed to respective first and second runs so that the doors move simultaneously in opposite directions when the drive sprocket is rotated, whereby the doors may be opened or closed by means of a single drive motor which can be actuated to drive the sprocket in opposite directions. The doors are constantly urged toward a closed position (or, alternatively, toward an open position as a matter of design choice) by means of a suspended weight attached to one of the lead trolleys by a cable routed over one or more pulleys; the pulleys can be arranged so that the cable can be attached to either lead trolley and the weight can be at the same end of the track as the motor or the other end. The motor is blocked against rotation by a known electrical mechanism such as a solenoid actuated clutch or a disk brake when the sprocket is not being driven, the mechanism being released so that the motor can turn freely when electrical power to the motor or to a brake is interrupted or otherwise in response to a detected smoke or fire condition. Alternatively, in lieu of a suspended weight, a battery backup system can be provided for operating the motor to close (or open) the doors in response to an alarm condition.

The two-sided door according to the invention may be implemented as an accordion folding door or as a sliding door, the type of door and the arrangement of the components such as the motor and the weight generally being selected in dependence on design criteria such as the space available in the building walls at opposite ends of the head track.

The drive arrangement according to the invention may also be implemented as a single-sided fire door, wherein the single door is driven in opposite directions by an endless chain passing around a sprocket driven by a motor, the door being closed automatically by a suspended weight located at either end of the head track when the motor is unblocked. When implemented as an accordion-type folding door, the single-sided door resembles half of the two-sided door. When implemented as a sliding door, the lead trolley can be located proximate to the drive motor rather than remotely from it, and the sliding door can be drawn fully into a wall pocket along a rail which is offset from the centerline of the chain loop. This offers an advantage over a conventional side-coiling fire door insofar as the wall may be relatively narrow because it does not have to accommodate a coiled door.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
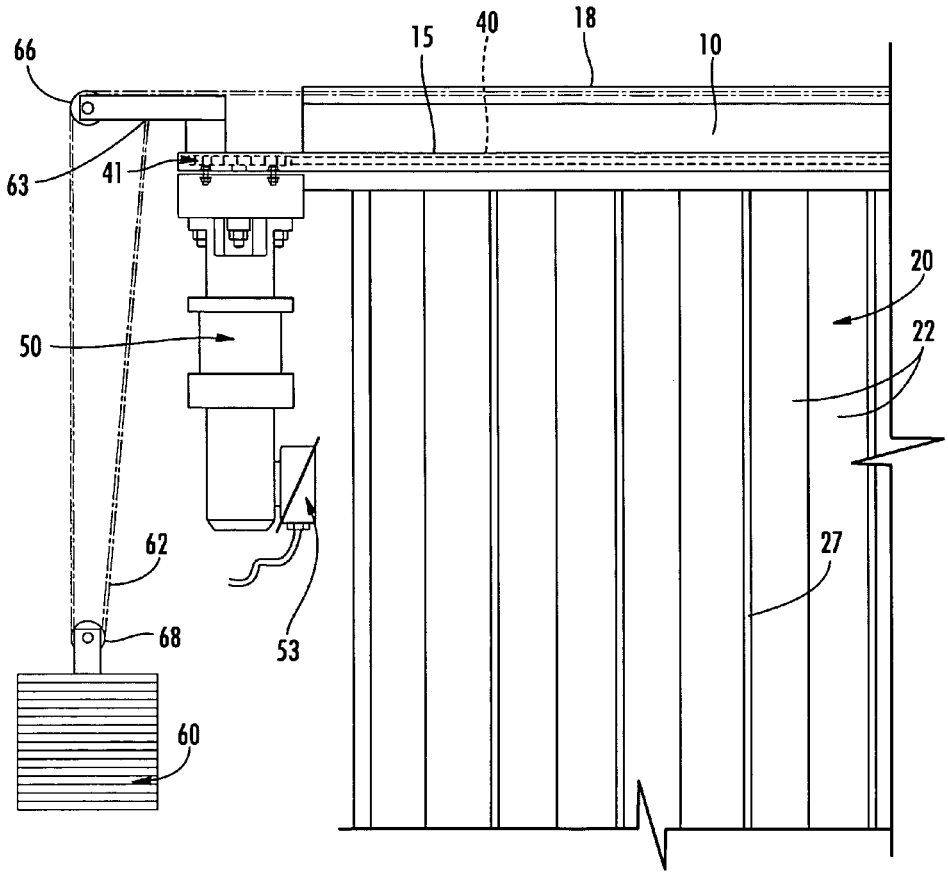
FIG. 1 is a partial elevation view of elevation view of a two-sided fire door system having accordion-type doors.

FIG. 1 shows a first door 20 of a two-sided fire door, a head track 10 from which the door is suspended by trolleys 30

(FIGS. 2-4), an enclosed chain 40 for opening and closing the door, a motor 50 for driving the chain, and a counterweight 60 for automatically closing the door when the motor 50 is not engaged for operative displacement to the chain 40. The counterweight 60 is suspended by a cable 62 having a first end 63 fixed to a stationary frame member and a second end 64 fixed to a trolley (FIG. 2), the cable passing over one or more movable pulleys 68 fixed to the weight 60 and one or more first fixed pulley 66 on the frame member. This arrangement causes the door to move twice as far horizontally as the weight moves vertically, which not only limits the dropped distance but reduces stress on the drive motor 50 when the doors are opened against the force exerted by the weight 60. As will be apparent, the location of the counterweight 60 and attachment of the chain second end 64 to a trolley can be modified to cause the automatic opening, instead of closing, of the door when the motor 50 is not engaged for operative displacement of the chain 40, as a general matter of design choice within the scope and contemplation of the invention.

Figure 2:
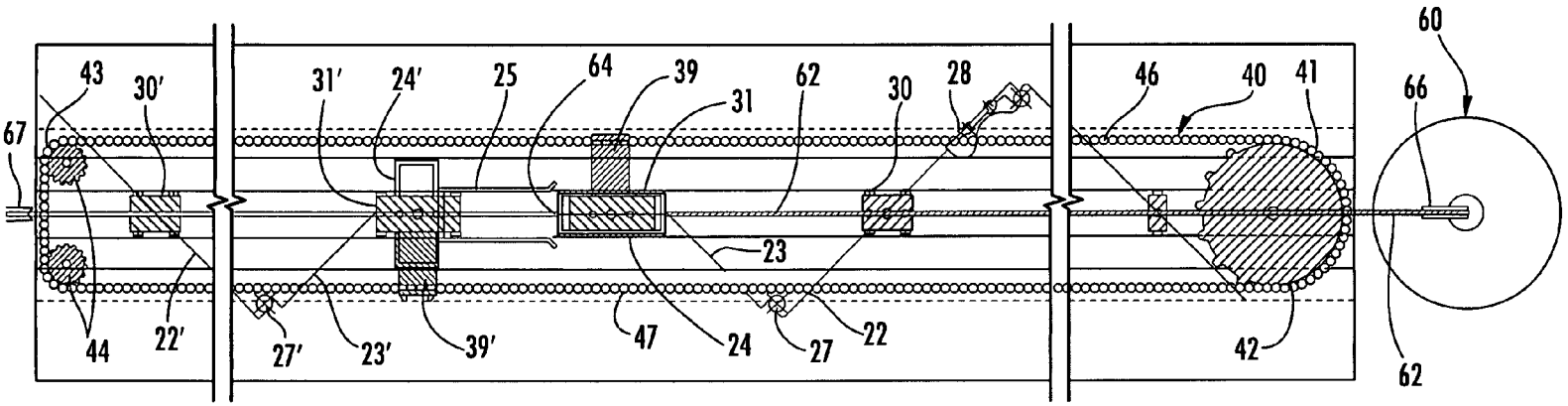
FIG. 2 is a plan view of the door system of FIG. 1.
Figure 10A:
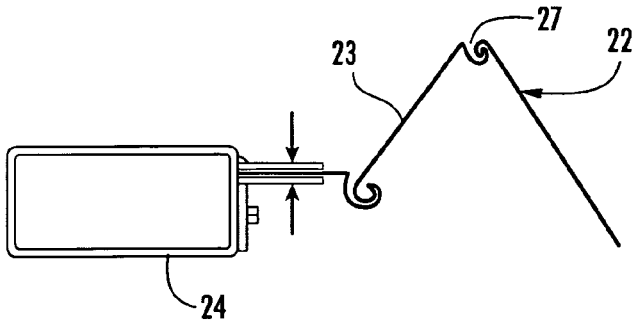
FIG. 10A is a detail of a door leading edge tube suspended from the leading trolley of an accordion-type door.

FIG. 2 shows the first door 20 and the second door 20' having respective panels 22, 22' suspended from trolleys 30, 30' and hinged together in known fashion at hinges 27, 27' so that adjacent panels rotate in opposite directions as the doors close or open, whereby the doors are known as accordion-type doors. The panels 22, 22' include respective lead panels 23, 23' which are hinged to tubes 24, 24', as shown in greater detail in FIG. 10A. The tubes 24, 24' are suspended from lead trolleys 31, 31'. The drive chain 40, preferably no. 40, is an endless chain in an elongate loop having a first loop end 41 passing around a drive sprocket 42, a second loop end 43 passing around a pair of idler sprockets 44, and first and second parallel runs 46, 47 extending between the ends 41, 43. The first lead trolley 31 is fixed to the first run 46 by an outrigger 39, and the second lead trolley 31' is fixed to the second run 47 by an outrigger 39'. When the motor 50 is actuated to rotate the sprocket 42 counter-clockwise, trolleys 31, 31' move together to close the doors 20, 20'. When the motor 50 is actuated to rotate the sprocket 42 clockwise, the trolleys 31, 31' move apart to open the doors 20, 20' against the force of the counter-weight 60. In a fully open position, the panels 22 and 22' form stacks, and the locks 28 latch at least two of the panels together (the latching force can be overcome by the motor or the counterweight). When the motor 50 is released, the counterweight 60 pulls the doors closed by means of cable 62, which passes over a second fixed pulley 67 and whose second end 64 is fixed to first lead trolley 31 to pull it toward the second lead trolley 31'. As will be explained, it is also possible to attach the second end 64 of the cable to the second lead trolley 31' and dispense with the second fixed pulley 67. Since both lead trolleys 31, 31' are fixed to the endless drive chain 40, the trolleys 31, 31' move toward each other synchronously until the tube 24 is received in a receptacle 25 fixed to the tube 24'.

A blocking means is provided for blocking rotation of the drive sprocket 42 when the drive motor 50 is not operating. The blocking means can comprise an electrically operated device, which is configured so that the doors 20, 20' open or close automatically when the electrically operated device loses power. For example, the electrically operated device can comprise one of a solenoid and a magnetic disk brake.

Figure 3:
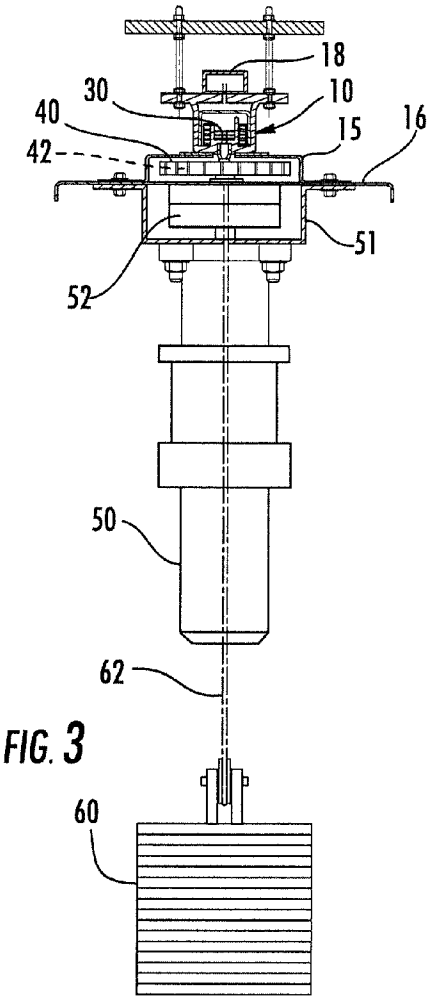
FIG. 3 is an end section view of the system showing the sprocket drive and counterweight.

Referring also to FIG. 3, the drive arrangement includes motor 50, motor bracket 51, an optional solenoid-actuated clutch 52, and a connection box 53 (FIG. 1). The clutch 52 remains engaged whenever the doors are in an open position, and disengages in the event of a power failure or when the power is interrupted by means of a connection to a fire or smoke detection system. This function may also be achieved by an electrically actuated disk brake or a solenoid-actuated brake. When the clutch 52 (or a brake) is disengaged, the sprocket 42 can turn freely so that weight 60 falls and the cable 62 is drawn through cable guide 18 and pulls the lead trolleys together until the doors are closed. As the trolleys are moving together, the individual panels pivot toward a coplanar position. A floor track may also be provided or may be dispensed with, in which case the panels preferably remain at an angle for increased stability of the closed doors.

Figure 4:
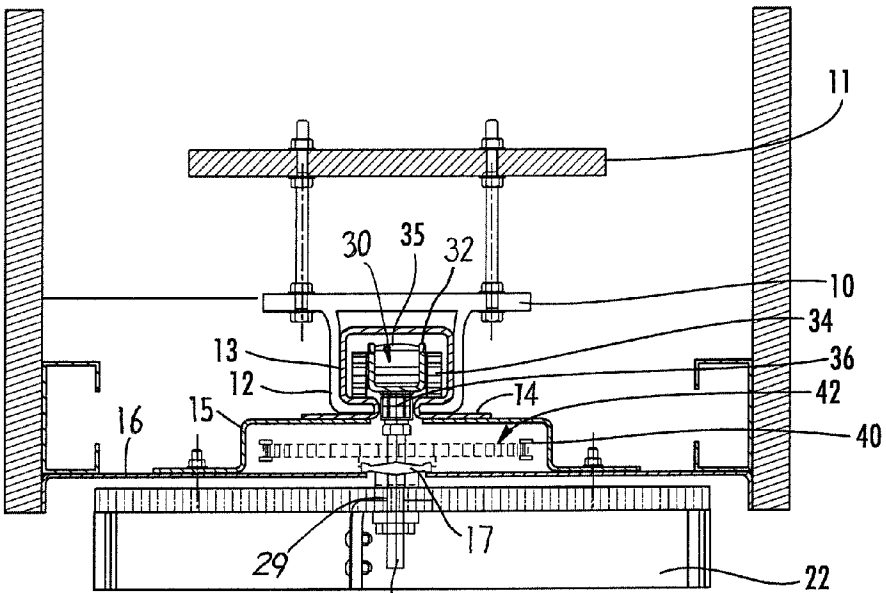
FIG. 4 is an end section view of the head track showing a trolley attached to an accordion-type door panel.

FIG. 4 shows the head track 10 and a trolley 30 in greater detail. The track 10 is shown retained in one of a plurality of spaced apart support brackets 12 which are fixed to a structural support 11 by bolts that permit adjustment of the position of the track. Flanges 14 of the track 10 extend outwardly below the track and are fixed to an enclosure 15 for the chain 40. The chain enclosure 15 is fixed to a pan 16 which is mounted between vertically-disposed dry wall members or the like. All components 10-16 are preferably constructed or fabricated of steel.

The trolley 30 includes a U-shaped frame 32 in which axles carrying the vertical support rollers 34 are journaled. Where this is a lead trolley 31, there are preferably two pairs of 1½ inch diameter rollers 34; for other trolleys (following trolleys) there are preferably two pairs of 1 inch diameter rollers 34. Where it is desired to have the cable 62 pull directly on the second lead trolley 31', a cross bar 35 can be provided as an attachment point, the cable 62 passing within the rail 10 and insert 13, above the individual trolleys of the first door 20. The guide 18 and second pulley 67 are not needed. There are also four horizontal guide rollers 36 journaled on pins extending vertically from the U-shaped frame 32 and passing between the track flanges 14 to provide lateral stability and smooth action. A pendant member 38 extending downward from the frame 32 passes between brush seals 17 and carries a swivel joint 29 for door panel 22. The outrigger 39 (FIG. 2) is fixed to the pendant member 38 of the lead trolley 31.

Figure 5:
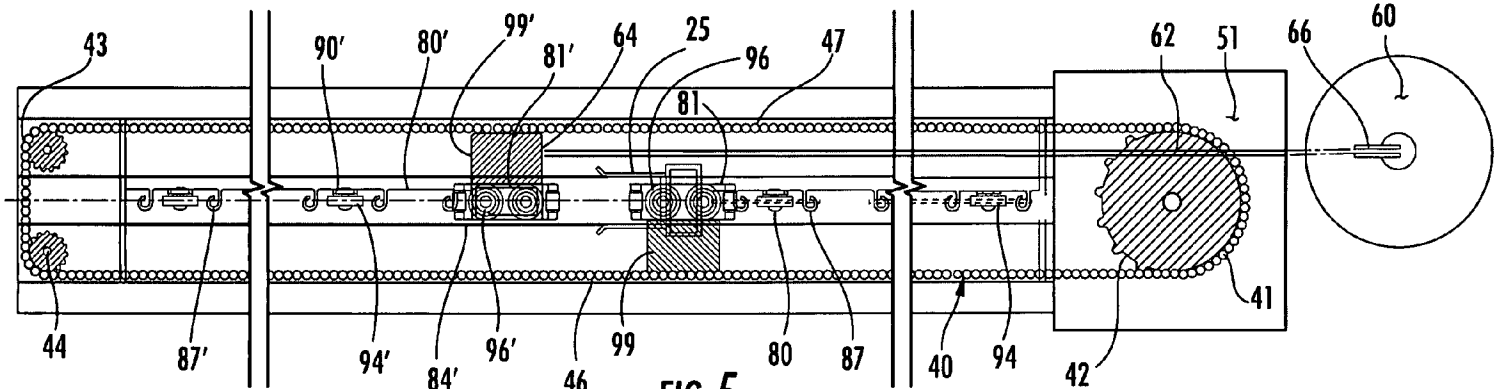
FIG. 5 is a plan view of a two-sided fire door system having sliding doors.
Figure 10B:
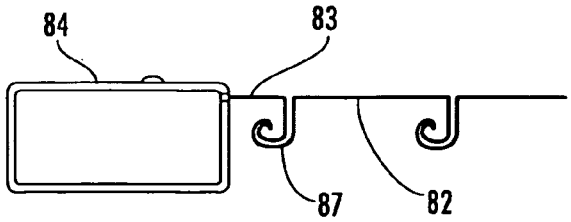
FIG. 10B is a detail of a door leading edge tube suspended from the leading trolley of a sliding-type door.

FIG. 5 shows a second embodiment of a two-sided fire door according to the invention, wherein the first and second doors 80, 80' comprise panels 82, 82' which are suspended from trolleys 90, 90' and hinged together in known fashion at hinges 87, 87' so that adjacent panels 82, 82' pivot in the same direction as the doors move around curves, e.g. into a curved wall or around a corner. Such doors are known as sliding doors and may be received in wall pockets, which are well known and therefore not illustrated. The lead panels 83, 83' are hingedly connected to tubes 84, 84', as shown in greater detail in FIG. 10B. The tubes 84, 84' are suspended from the lead trolleys 91, 91'. Here, too, the drive chain 40 is an endless chain in an elongate loop having a first loop end 41 passing around a drive sprocket 42, a second loop end 43 passing around a pair of idler sprockets 44, and first and second parallel runs 46, 47 extending between the ends 41, 43. The first lead trolley 91 is fixed to the first run 46 by a outrigger 99, and the second lead trolley 91' is fixed to the second run 47 by a outrigger 99'. The operation of the motor 50 and counterweight 60 is as described for FIG. 2. The cable 62 could be connected to either of the first and second lead trolleys 91, 91', as illustrated for trolleys 31, 31' in FIGS. 1-4, but is shown connected to the outrigger 99 by way of example. This requires offsetting the fall line of the weight from the centerline of the chain loop and may not be suitable in some wall constructions.

In this regard it should be noted that the weight 60 may be placed adjacent to the second loop end 43 of the chain 40, opposite from the motor 50 at the first end 41, where wall space is limited at the first end and available at the second end.

This simply requires attaching the cable to the opposite lead trolley in a mirror image arrangement to those already described.

Figure 6:
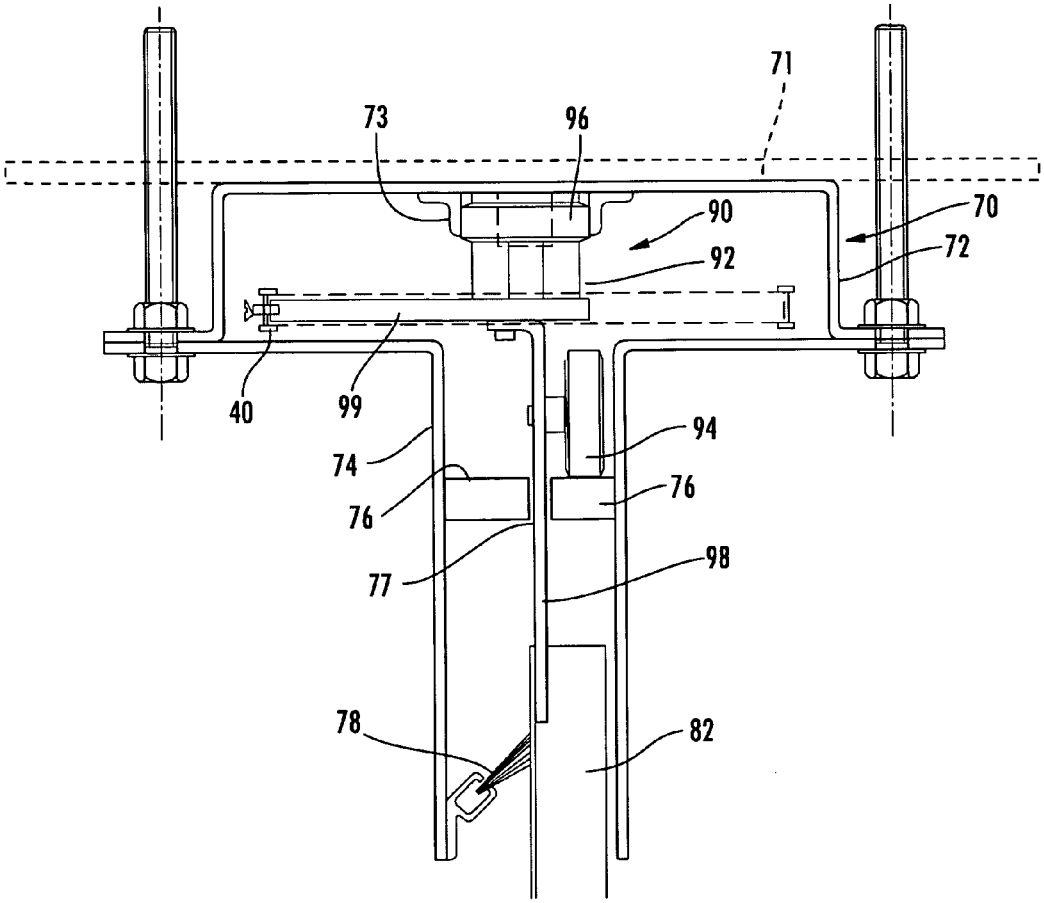
FIG. 6 is an end section view of the head track showing a trolley attached to a sliding door panel.

FIG. 6 shows details of the head track 70 and trolley 90 in the sliding door arrangement of FIG. 5. The head track 70 is adjustably mounted to a structural support (not shown) and includes an enclosure 72 having lateral guide rails 73. The enclosure 72 is fixed to L-shaped floor members 74 having internal support rails 76 which are spaced apart by a gap 77. The lead trolley 91 includes a frame 92 in which a pair of horizontal guide rollers 96 are journaled, the outrigger 99 being fixed between the frame 92 and chain 40. A vertical guide roller 94 is journaled to pendant member 98 extending downward from the frame, and rides on support rail 76. The other support rail 76 simply acts as a spacer member defining the gap 77 that receives the pendant member 98 and improves lateral stability of the trolley 90. For trolleys 90 other than the lead trolley, i.e. the following trolleys, the horizontal guide rollers 96 may be dispensed with, as shown in FIG. 5.

Figure 7:
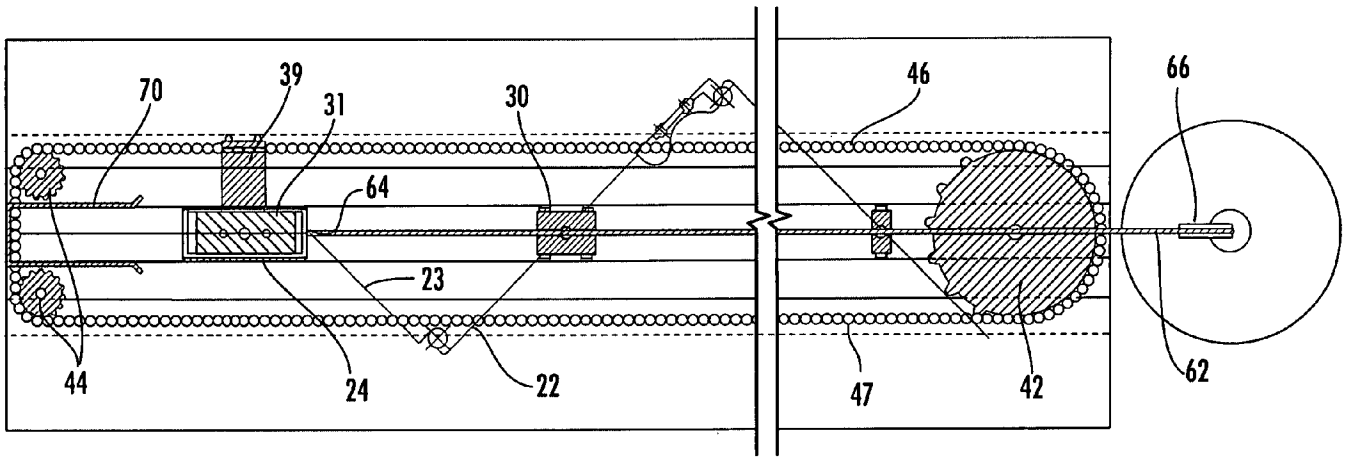
FIG. 7 is a plan view of a single-sided door having an accordion-type door.

FIG. 7 shows a single-sided accordion-type fire door according to the invention, wherein the same reference numerals used in FIGS. 1-4 are used for simplicity. FIG. 7 is similar to FIG. 2, but the second door 20' is not present.

FIGS. 1, 3, and 4 apply as well with FIG. 7. The first lead trolley 31 is fixed to first run 46 of chain 40 by outrigger 39 and moved toward open and closed positions by actuating the drive motor 50 to rotate the drive sprocket 42 in opposite directions. When the motor 50 is not operably connected to the drive sprocket 42, the lead trolley 31 is drawn to the right (in the Figure) to close the door 20 by the action of cable 62 passing over pulleys 66 and 68. By adding an additional fixed pulley 67 (as for example shown in FIG. 2) over which the cable 62 is lead the lead trolley can be caused to move instead to the left, or the weight can be installed at the opposite end of the head track 10 from motor 50. Modifications to cause the door 20 to open, instead of close, under the urgency of weight 60 will also be apparent (in this and the other embodiments herein disclosed) as a general matter of design choice.

Figure 8:
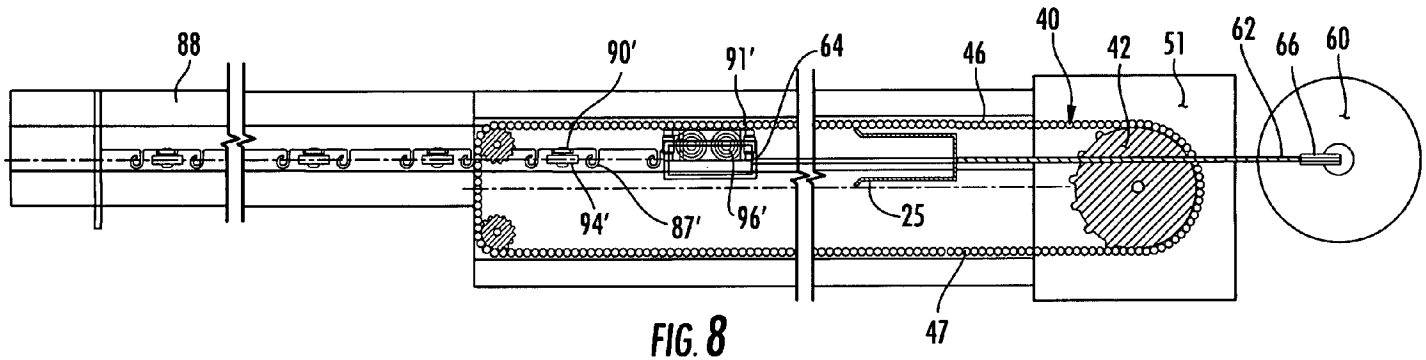
FIG. 8 is a plan view of a single-sided door having a sliding-type door.

FIG. 8 shows a single-sided sliding fire door according to the invention, wherein the same reference numerals used in FIGS. 5-6 are used for simplicity. FIG. 8 is similar to FIG. 5, but the first door 80 is not present, and the sliding door 80' moves on a path which is offset from the centerline of the chain runs 46, 47. The second lead trolley 91' is fixed to first run 46 of chain 40 and moves the second door 80' toward open and closed positions when the drive motor 50 is actuated to rotate the drive sprocket 42 in opposite directions. In the open position, the door 80' is received in a wall pocket 88. When the motor 50 is not operably connected to the drive sprocket 42, the lead trolley 91' is drawn toward a closed position by the action of cable 62 passing over pulleys 66 and 68, and the tube 84' suspended from the lead trolley 91' engages in the receptacle 25. Routing of the cable 62 is relatively simple because there are no intervening trolleys. If it is desired to install the weight at the opposite end of the chain, a second fixed pulley 67 becomes necessary to reverse the direction of the cable.

Figure 9:
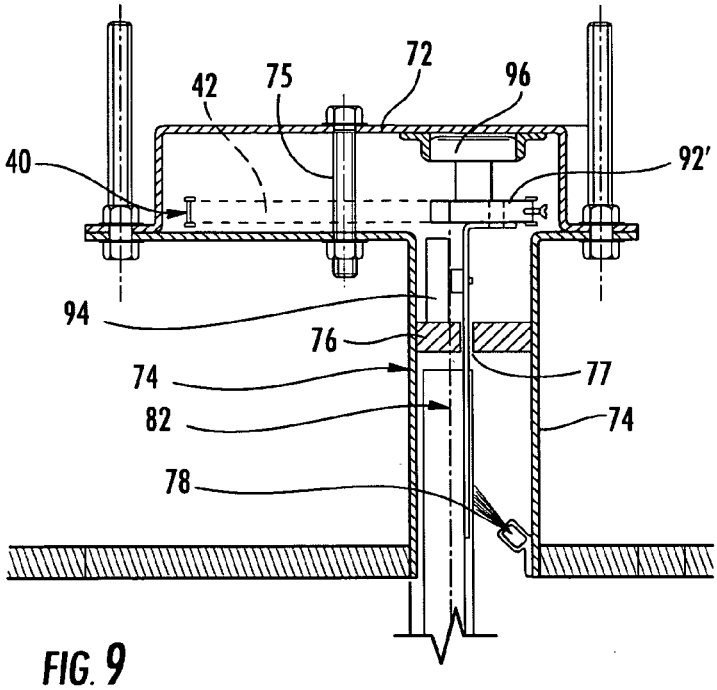
FIG. 9 is an end section view of the head track showing a trolley attached to a door panel of a single-sided sliding-type door.

FIG. 9 shows a detail of the head track 70 and lead trolley 91' in FIG. 8. The head track includes an enclosure 72 having lateral guide rails 73 which are offset from the centerline of the enclosure, which is provided with a bolt 75 to provide additional support for one of the L-shaped floor members 74. The L-shaped floor members carry support rails 76 separated by a gap 77. The lead trolley 91' includes a frame 92' in which a pair of horizontal guide rollers 96' are journaled, the frame 92' being fixed directly to chain 40. A vertical guide roller 94' is journaled to pendant member 98' extending downward from the frame 92', and rides on support rail 76. The other support rail 76 simply acts as a spacer member defining the gap 77 that receives the pendant member 98' and improves lateral stability of the trolley 91'. For trolleys other than the lead trolley, i.e. the following trolleys, the horizontal guide rollers 96' may be dispensed with, as shown in FIG. 8.

Modifications of the within-disclosed embodiments to implement automated closing, or opening, of the one or two fire doors—in response to a loss of normal operating power or to a detected alarm or smoke condition or to any other predetermined trigger event—through powered operation of the motor 50 by a battery backup system in lieu of (or, if desired, as an adjunct or available alternative or assist to) use of the weight 60 are also within the intended scope and contemplation of the invention. Thus, the inventive system may be implemented with a weight 60 for operative automated opening or closing of the fire door(s), with a battery backup system for operative automated opening or closing of the fire door(s), or with both a weight and a battery backup system to provide that functionality in response to an alarm or smoke or other predetermined condition or trigger event, as a general matter of design choice. Any of the inventive embodiments herein described or otherwise apparent therefrom may be modified, in ways which will be apparent to those skilled in the relevant arts having knowledge of this disclosure, to incorporate such battery backup operation for automated opening or closing of a fire door system constructed in accordance with the present invention.

While reference has been made primarily to fire doors, the invention is not limited to fire doors as that term might be narrowly construed by one skilled in the art. Rather, the invention is applicable to any doors or partitions formed of any interconnected panels suspended and driven as shown and described. In particular, the invention is applicable to operable partitions, as that term is used by those skilled in the art to refer to interconnected fire-rated panels used to partition a large room into smaller rooms. Thus, the term fire door, as used herein, will be broadly construed to include not only fire rated doors having interconnected panels suspended and driven as shown and described, but also fire rated partitions having interconnected panels suspended and driven as shown and described.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A two-sided fire door system comprising:

a horizontal head track having a first end and a second end;

a first door comprising a plurality of first interconnected panels suspended vertically from the head track by a first group of trolleys following a first lead trolley remote from the first end, the first group of trolleys being arranged for horizontal movement between the first end and a point remote from the first end;

a second door comprising a plurality of second interconnected panels suspended vertically from the head track by a second group of trolleys following a second lead trolley remote from the second end, the second group of trolleys being arranged for horizontal movement between the second end and a point remote from the second end;

an endless chain in an elongate loop having a first end looped around a drive sprocket, a second end looped around at least one idler sprocket, a first run extending between the ends of the loop on one side of the head track, the first lead trolley being fixed to the first run, and a second run extending between the ends of the loop on the other side of the head track, the second lead trolley being fixed to the second run;

a drive motor arranged to drive the drive sprocket in a first rotational direction wherein the lead trolleys move toward each other to close the doors, and a second rotational direction wherein the lead trolleys move away from each other to open the doors;

a brake for blocking rotation of the drive sprocket when the drive motor is not operating; and means for urging the lead trolley in one of the first and second directions when the motor is not operating and the brake is released, whereby the door either opens or closes automatically.

2. The fire door system of claim 1 wherein the lead trolleys are urged toward each other, whereby the doors close when the motor is not operating and the brake is released.

3. The fire door system of claim 1 wherein the means for urging the lead trolleys comprises a suspended weight connected to one of the lead trolleys by a cable passing over a first pulley.

4. The fire door system of claim 3 further comprising a second pulley fixed to the suspended weight, the cable passing over the second pulley.

5. The fire door system of claim 3 wherein the suspended weight is arranged adjacent to the first end of the head track and the cable is connected to the second lead trolley, whereby the doors close when the motor is not operating and the brake is released.

6. The fire door system of claim 5 wherein the drive motor is arranged adjacent to the suspended weight at the first end of the head track.

7. The fire door system of claim 1 wherein the drive sprocket has a diameter which defines a distance between the first and second runs of chain.

8. The fire door system of claim 1 wherein the second end of the chain is looped around a pair of idler sprockets, the idler sprockets lying on respective sides of the head track and defining a distance between the first and second runs of chain.

9. The fire door system of claim 1 wherein the panels of a respective one of the first and second doors have vertical sides which are hinged together so that the panels of the respective one of the first and second doors form an accordion-like door, at least some of the panels of the respective one of the first and second doors being suspended from the respective one of the first and second groups of trolleys, each of the trolleys being located midway between the vertical sides of the respective panel.

10. The fire door system of claim 1 wherein the panels have vertical sides which are hinged together so that the panels can pivot with respect to each other and can travel on a curved path.

11. The fire door system of claim 1 wherein the brake of the drive sprocket comprises an electrically operated device, whereby the doors open or close automatically when the electrically operated device loses power.

12. The fire door system of claim 11 wherein the electrically operated device comprises one of a solenoid and a magnetic disk brake.

13. The fire door system of claim 11 wherein the system is installed as an operable partition in a room.

14. A fire door system comprising:

a horizontal head track having a first end and a second end;

a door comprising a plurality of interconnected panels suspended vertically from the head track by trolleys following a lead trolley, the lead trolley being arranged for horizontal movement between the first end and a point remote from the first end;

an endless chain in an elongate loop having a first end looped around a drive sprocket, a second end looped around at least one idler sprocket, a first run extending between the ends of the loop on one side of the head track, and a second run extending between the ends of the loop on the other side of the head track, the lead trolley being fixed to the first run;

a drive motor arranged to drive the drive sprocket in a first rotational direction to move the lead trolley in a first linear direction toward the first end, and in a second rotational direction to move the lead trolley in a second linear direction away from the first end;

a brake for blocking rotation of the drive sprocket when the drive motor is not operating; and means for urging the lead trolley in one of the first and second directions when the motor is not operating and the brake is released, whereby the door either opens or closes automatically.

15. The fire door system of claim 14 wherein the lead trolley is urged in the second linear direction so that the door closes when the motor is not operating and the brake is released.

16. The fire door system of claim 15 wherein the means for urging the lead trolley comprises a suspended weight connected to the lead trolley by a cable passing over at least one pulley.

17. The fire door system of claim 16 wherein the suspended weight is arranged adjacent to the second end of the head track and the electric motor is arranged adjacent to the first end of the head track.

18. The fire door system of claim 14 wherein the door is an accordion-type door, the trolleys further comprising following trolleys, the following trolleys lying between the lead trolley and the first end.

19. The fire door system of claim 14 where the door is a sliding door, the trolleys further comprising following trolleys lying opposite the lead trolley from the first end.

20. The fire door system of claim 19 further comprising a pocket which receives the head track and the sliding door.

21. The fire door system of claim 14 wherein the system is installed as an operable partition in a room.

22. A two-sided fire door system comprising:

a horizontal head track having a first end and a second end;

a first door comprising a plurality of first interconnected panels suspended vertically from the head track by a first group of trolleys following a first lead trolley remote from the first end, the first group of trolleys being arranged for horizontal movement between the first end and a point remote from the first end;

a second door comprising a plurality of second interconnected panels suspended vertically from the head track by a second group of trolleys following a second lead trolley remote from the second end, the second group of trolleys being arranged for horizontal movement between the second end and a point remote from the second end;

an endless chain in an elongate loop having a first end looped around a drive sprocket, a second end looped around at least one idler sprocket, a first run extending between the ends of the loop on one side of the head track, the first lead trolley being fixed to the first run, and a second run extending between the ends of the loop on the other side of the head track, the second lead trolley being fixed to the second run;

a drive motor arranged to drive the drive sprocket, under normal operating power, in a first rotational direction wherein the lead trolleys move toward each other to close the doors, and a second rotational direction wherein the lead trolleys move away from each other to open the doors;

a brake for blocking rotation of the drive sprocket when the drive motor is not operating under normal operating power; and means for urging the lead trolley in one of the first and second directions when the motor is not operating and the brake is released, whereby the door either opens or closes automatically.

23. The two-sided fire door system of claim 22, wherein said means for urging the lead trolleys when the motor is not operating under normal operating power and the brake is released comprises battery backup power for operating the motor.

24. The two-sided fire door system of claim 22, wherein said means for urging the lead trolleys when the motor is not operating under normal operating power and the brake is released comprises a suspended weight connected to one of the lead trolleys by a cable passing over a first pulley.

25. The two-sided fire door system of claim 22, wherein the lead trolleys are urged either toward or away from each other to close the doors when the motor is not operating under normal operating power and the brake is released.

26. The two-sided fire door system of claim 22, wherein the system is installed as an operable partition in a room.

27. A fire door system comprising:

a horizontal head track having a first end and a second end;

a door comprising a plurality of interconnected panels suspended vertically from the head track by trolleys following a lead trolley, the lead trolley being arranged for horizontal movement between the first end and a point remote from the first end;

an endless chain in an elongate loop having a first end looped around a drive sprocket, a second end looped around at least one idler sprocket, a first run extending between the ends of the loop on one side of the head track, and a second run extending between the ends of the loop on the other side of the head track, the lead trolley being fixed to the first run;

a drive motor arranged to drive the drive sprocket, under normal operating power, in a first rotational direction to move the lead trolley in a first linear direction toward the first end, and in a second rotational direction to move the lead trolley in a second linear direction away from the first end;

a brake for blocking rotation of the drive sprocket when the drive motor is not operating under normal operating power; and means for urging the lead trolley in one of the first and second directions whereby, when the motor is not operating and the brake is released, whereby the door either opens or closes automatically.

28. The fire door system of claim 27, wherein said means for urging the lead trolley when the motor is not operating under normal operating power and the brake is released comprises battery backup power for operating the motor.

29. The fire door system of claim 27, wherein said means for urging the lead trolley when the motor is not operating under normal operating power and brake is released comprises a suspended weight connected to one of the lead trolley by a cable passing over a first pulley.

30. The fire door system of claim 27, wherein the system is installed as an operable partition in a room.

* * * * *